United States Patent [19]

Brighigna

[11] Patent Number: 4,995,362

[45] Date of Patent: Feb. 26, 1991

[54] MALFUNCTION OVERRIDE DEVICE FOR THE FUEL INJECTION SYSTEMS OF COMPRESSION-IGNITION ENGINES

[75] Inventor: Mario Brighigna, Cento, Italy

[73] Assignee: VM Motori S.P.A., Italy

[21] Appl. No.: 472,321

[22] Filed: Jan. 30, 1990

[30] Foreign Application Priority Data

Sep. 7, 1989 [IT] Italy ..... 3613 A/89

[51] Int. Cl.[5] ..... F02D 31/00; F02B 77/00

[52] U.S. Cl. ..... 123/365; 123/198 D; 123/372

[58] Field of Search ..... 123/365, 364, 495, 372, 123/198 D, 198 DB, 377, 396, 397, 198 F

[56] References Cited

U.S. PATENT DOCUMENTS

| | | | |
|---|---|---|---|
| 1,943,974 | 1/1934 | Junkers | 123/365 |
| 4,297,979 | 11/1981 | Kamleitner | 123/198 F |
| 4,417,555 | 11/1983 | Deutschmann | 123/372 |
| 4,512,305 | 4/1985 | Pitozzi | 123/372 |
| 4,516,542 | 5/1985 | Aoyoma | 123/198 F |

FOREIGN PATENT DOCUMENTS

| | | | |
|---|---|---|---|
| 1094042 | 12/1960 | Fed. Rep. of Germany | 123/372 |
| 2822195 | 11/1979 | Fed. Rep. of Germany | 123/372 |
| 3119011 | 3/1982 | Fed. Rep. of Germany | 123/365 |
| 0233864 | 3/1986 | German Democratic Rep. | 123/372 |
| 2028425 | 3/1980 | United Kingdom | 123/365 |

*Primary Examiner*—Carl Stuart Miller

*Attorney, Agent, or Firm*—Fay, Sharpe, Beall, Fagan, Minnich & McKee

[57] ABSTRACT

The device comprises a control rod running parallel to the fuel injection pump and affording a rigidly associated collar alongside each pumping element; each such collar is sandwiched between a pair of spring-loaded sleeves slidably mounted to the rod and incorporating a relative pair of peripheral tongues by which the internal metering mechanism of the element is rotated between two limit positions corresponding to the maximum and minimum delivery settings of the pump; the calibrated force of the springs is balanced against the resistance offered by the metering mechanism in such a way as to enable continued operation of the rod even in the event that at least one mechanism should jam at a given point between its two limit positions.

5 Claims, 4 Drawing Sheets

9
22
24
21b
20b
13b
5
8
13a
21a
20a
11
X
12
1

MALFUNCTION OVERRIDE DEVICE FOR THE FUEL INJECTION SYSTEMS OF COMPRESSION-IGNITION ENGINES

BACKGROUND OF THE INVENTION

The present invention relates to a override device for malfunction in fuel injection systems, intended in particular for compression ignition engines such as diesels.

Persons familiar with the design of diesel engines know that a typical fuel injection system comprises two basic components by means of which fuel is supplied to the combustion chamber, namely, the injection pump and the injector.

Of fuel injection systems currently in use, the most widely adopted is the mechanical type, which offers uncomplicated design and operation, together with notable dependability, and is both simple and economical to maintain.

Numerous types of equipment have been developed for mechanical fuel injection; these fall into two main categories: those utilizing a common rail, which simply accumulate pressure, and those using a timed jerk pump to generate pressure intermittently.

The following specification refers exclusively to the second, timed type of system, currently in the ascendancy due to its adoption in high/medium speed diesel units of which the development has ballooned in recent times; whichever pressurization is used, at all events, two methods of fuel injection are possible: indirect, whereby fuel is injected into a combustion chamber remote from the piston, and direct, where the combustion chamber is formed in the crown of the piston itself.

The recent development in question stems largely from the notion of using diesel engines to propel light airplanes suitable for tourism; naturally, the key requirements for such engines will be connected with safe and dependable operation.

The fuel injection system in compression-ignition engines consists in a plurality of pump elements, corresponding in number to the cylinders of the engine, which supply the fuel through short pipes to a similar number of injectors.

The various elements of the injection pump, each supplying a relative injector, are mounted in a single crankcase disposed generally parallel with one another and operated by a camshaft rotating synchronously with the engine, with which contact is made through roller tappets. The volume of fuel delivered by each pumping element per unit of power required is metered through a measured rotation of the plunger of the pumping element itself, effected conventionally by means of either rack-and-pinion or rod-and-crank type linkages.

Precisely because of its structural configuration, this linkage can give rise to drawbacks of a nature such as seriously affect the normal running of the engine, one of which deriving from the rigidity of the rack or rod. In effect, should even one only of the pumping elements become jammed, due in most instances to the plunger seizing in the relative bore, this will inhibit control over the remaining elements as all are mechanically interlocked.

Whilst a malfunction of this kind could perhaps be regarded as little more than inconvenient in the engine of a vehicle or other power transmission on land, it is certainly unacceptable and hazardous in an aero engine; rather, in the interests of safety in flight, a loss of control over just one pumping element of the fuel injection system must in no way affect normal control over the remainder.

Accordingly, the object of the present invention is to overcome the drawbacks described above through the adoption of a control rod provided with one or more devices, installed in number equivalent to the number of elements of the injection pump, that will be capable of by-passing a possible malfunction of the nature outlined above and therefore of enabling the remainder of the fuel injection system, hence the engine, to continue operating substantially as normal.

SUMMARY OF THE INVENTION

The stated object is realized, according to the invention, by providing the rod that controls the metering facility of the injection pump with one rigidly attached shoulder for each element of the pump, each shoulder positively separating a pair of sleeves slidably ensheathing the rod and directed facing one another, the outer circumferences of which carry respective tongues by means of which to engage and maneuver the metering mechanism of the relative pump element between two limit positions corresponding to the maximum and minimum delivery settings of the pump.

Each single sleeve is tensioned by a respective spring calibrated so as to yield on encountering immobility of the relative metering mechanism, and compress at least through the distance separating the two limit positions, thereby enabling continued rectilinear motion of the rod.

Among the advantages of the present invention is that it ensures continued operation in the event that one or more elements of the fuel injection pump should happen to jam, hence that the relative sleeve or sleeves on the control rod should become immobilized; the rod can continue to operate the remaining unaffected elements of the pump, as with the springs being able to compress, the rod is permitted rectilinear movement in either direction. Accordingly, with continuing control ensured over normally-functioning parts of the system, greater operational dependability is similarly ensured, and notably at altitude, in the particular instance of an aero engine.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 4:
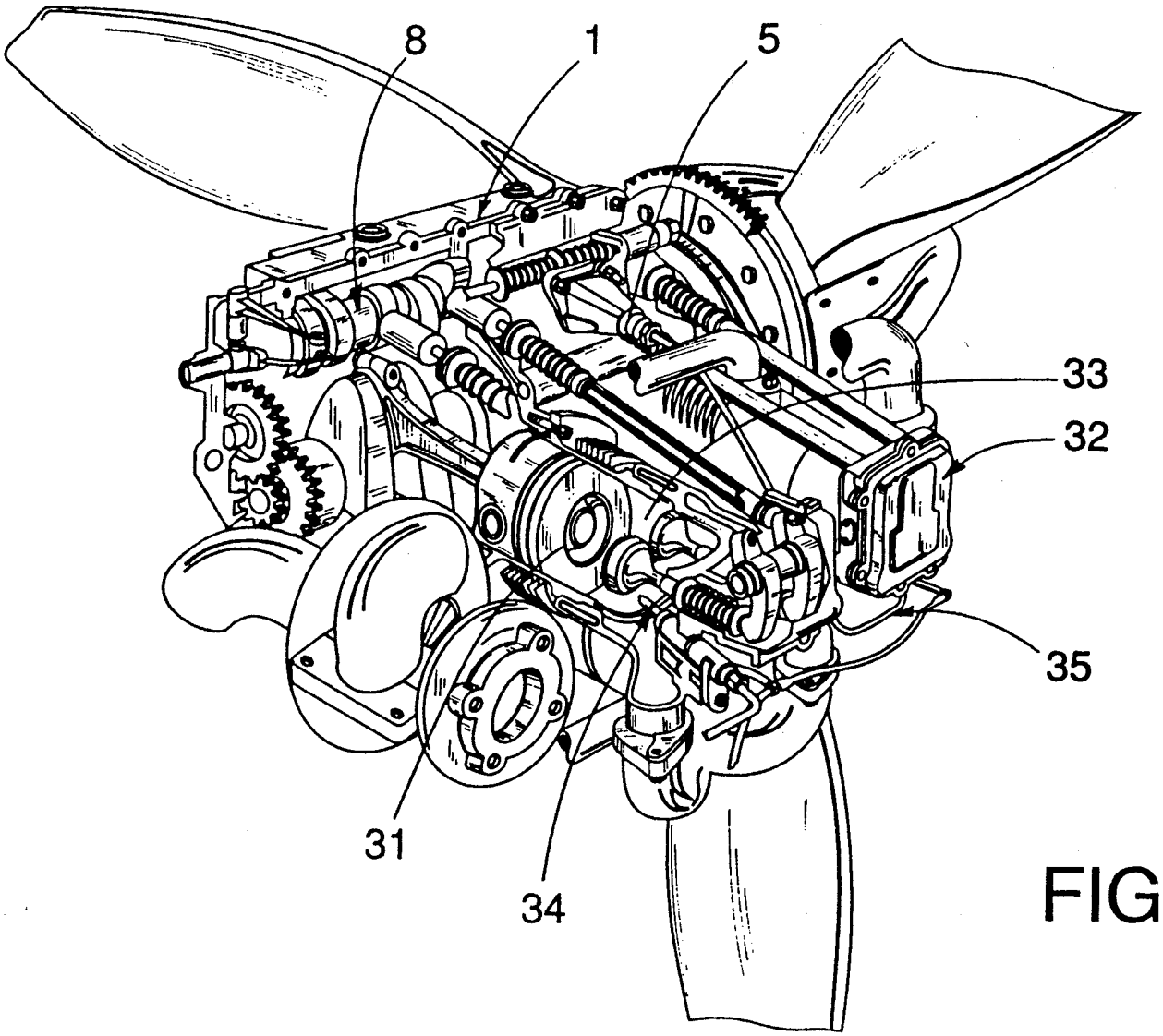
FIG. 4 is the cutaway perspective view of an aero engine incorporating the device according to the present invention.

Referring to the drawings, the device disclosed is intended for application to compression-ignition I.C. engines, typically diesels, or diesel-type engines running on jet aero fuel. Such an engine comprises a crankcase 1 and block accommodating a given number of pistons 31 (of which one is visible in FIG. 4), disposed parallel one with another and stroking internally of a cylinder head 32 located directly over and combining with the crankcase 1 to form a plurality of combustion chambers 33, one to each piston.

Figure 1:
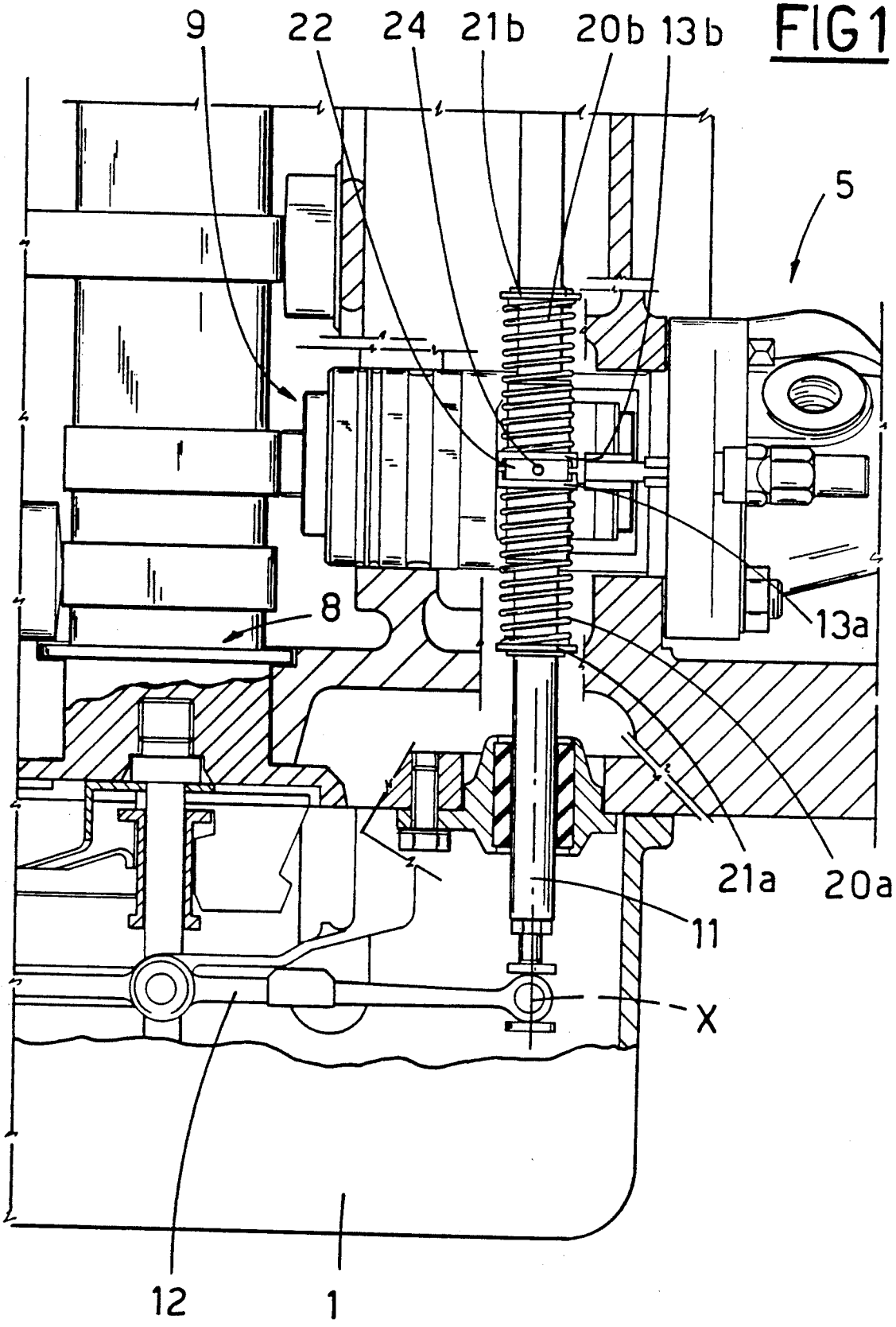
FIG. 1 illustrates the timing and fuel injection system of a diesel engine incorporating the device according to the present invention, viewed in plan from above with certain parts omitted better to reveal others.
Figure 2:
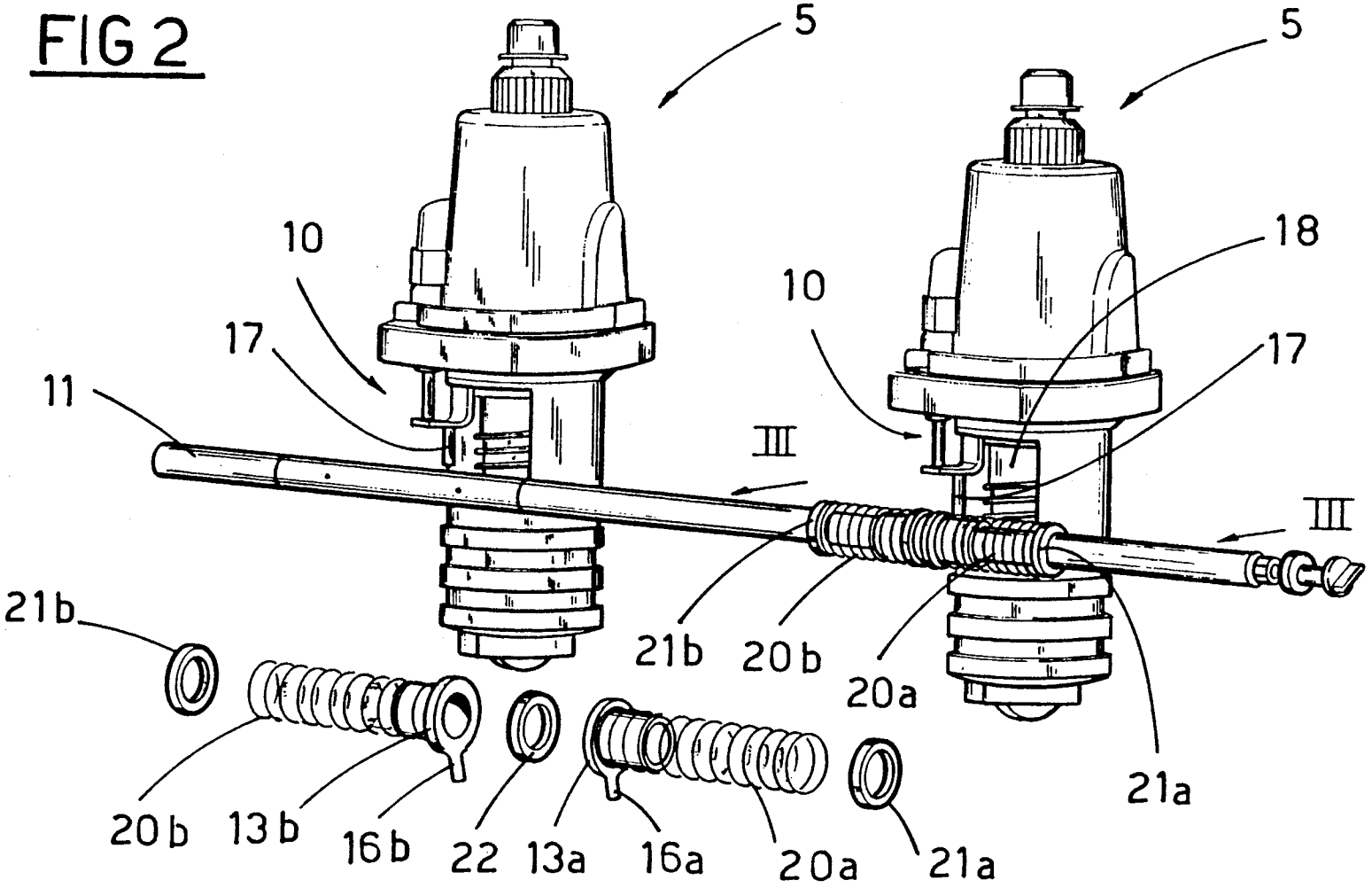
FIG. 2 illustrates two fuel injection pump elements in perspective, together with part of a control rod as in FIG. 1.

34 denotes one of a plurality of injectors (one per piston), each positioned with one end projecting into a relative combustion chamber 33 and connected by the remaining end to a pipeline 35, this in turn connecting with one respective element 5 of a fuel injection pump that is conventional in embodiment and therefore not described in detail. The various elements 5 are arranged parallel one with another and engaged by relative drive means 8, which in the example of FIGS. 1 and 4 consist in a camshaft made to occupy substantially a central and longitudinal position in the crankcase 1, and synchronized in its rotation with the movement of the pistons 31. The volume of fuel supplied by the pump element 5 to the injector is adjustable by way of rotatable metering means associated with the pump element 5 itself, denoted 10 in their entirety and described more fully in due course, which are engaged by a control rod 11 disposed parallel to the camshaft 8; the rod 11 is linked at one end to control means 12 capable of inducing rectilinear motion, which in the example of FIG. 1 appear as a rocker arm pivoted centrally to the crankcase 1, disposed transversely to the control rod 11 and operated from externally of the engine. Thus, movement of the control rod 11 along its own axis will produce a corresponding and uniform rotation of the metering means 10.

In the device according to the present invention, the rod 11 affords a rigidly associated shoulder 22 positioned alongside each element 5 of the pump and flanked by a pair of sliders; in the example of the drawings, the sliders consist in a pair of sleeves 13*a* and 13*b* which ensheath the rod 11 coaxially and are contraposed one on either side of the shoulder. Each sleeve 13*a* and 13*b* is provided peripherally with linkage and transmission means 14, consisting in two mutually parallel tongues 16*a* and 16*b* each integral with the contraposed end of a relative sleeve 13*a* and 13*b*, which project transversely from the rod to embrace and engage a vertically disposed pin 17 constituting part of the rotatable metering means 10 of the pump element 5.

More precisely, metering means 10 take the form of a bushing 18 rotatably and coaxially accommodated by the pump element 5, and provided with a strap 19 projecting from the element 5 toward the rod 11, which carries the vertical pin 17 at its farthest end.

Figure 3:
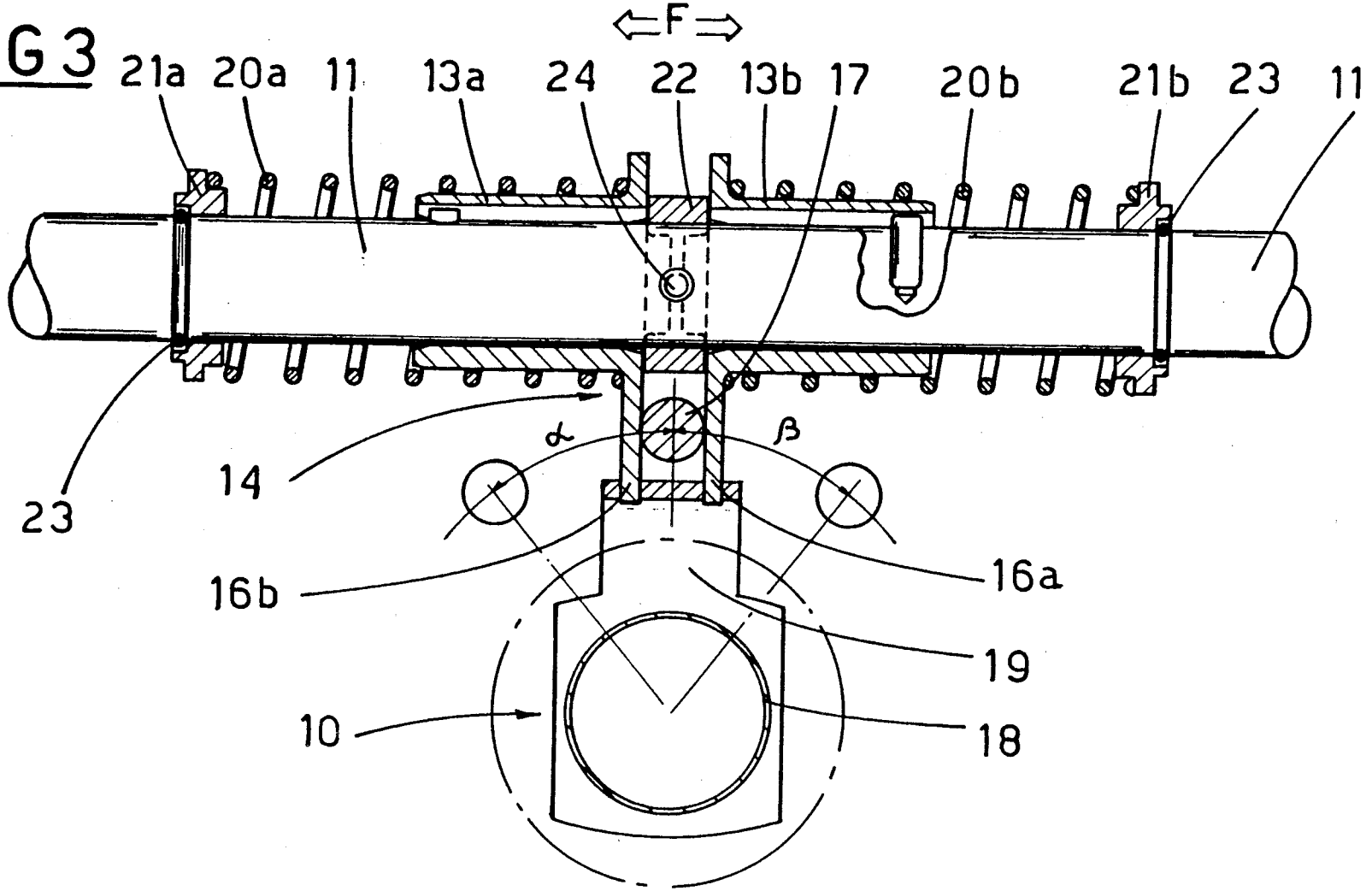
FIG. 3 is the section through III—III in FIG. 2, seen with certain parts omitted better to reveal others.

Each sleeve 13*a* and 13*b* is ensheathed by a relative spring 20*a* and 20*b* constituting tension means; the single spring 20*a* and 20*b* registers at one end with the corresponding contraposed end of the relative sleeve 13*a* and 13*b*, and at the other, with one of a pair of seating rings 21*a* and 21*b* which are fitted coaxially over and made fast to the control rod 11, for example by means of snap rings 23 seated in grooves afforded by the rod itself (FIG. 3).

FIG. 3 of the drawings provides a clear illustration of the shoulder 22, which will be seen to consist in a distance collar located between the respective contraposed ends of the two sleeves 13*a* and 13*b*; more exactly, the distance collar exhibits an axial dimension approximately equal to the diameter of the pin 17, and is secured to the rod 11 with a grub screw 24. The purpose of the collar 22 is to maintain a set distance between the two sleeves 13*a* and 13*b*, and to function as a stop against which each sleeve is biased into its operating position by the relative spring 20*a* and 20*b* on either side. With the engine running, the rod 11 thus embodied is able to govern the metering means 10 by passing on the movement transmitted by the operator from outside the crankcase through the rocker arm 12, alternating through a rectilinear path <-F-> (see FIG. 3) that will be either positive or negative in relation to the position of the pumping element 5; such a movement of the rod 11 causes the pin 17 and the bushing 18 to rotate as one between two limit positions, denoted $\alpha$ and $\beta$ in FIG. 3, corresponding to the maximum and minimum delivery settings of the injection pump. Needless to say, these positions will be adopted in concert by the metering means 10 of all parallel elements 5 connected to a common axis established by the control rod 11.

In the event that the metering means 10 of a given pump element 5 (that is, the rotatable bushing 18 and its relative pin 17) should become jammed, for example, due to an expansion of the material in which the pump casing or the metering means 10 is embodied, the rod 11 retains its ability to move in the rectilinear direction <-F-> and thus to meter the volume of fuel distributed by the remaining elements 5, given that the springs 20*a* and 20*b* flanking the jammed pin 17 will accommodate such movement; according to the invention, in fact, the springs are calibrated to produce a reaction force greater than that of which the metering means 10 are capable in normal operating conditions, but if confronted with an immobile pin 17, will compress between the obstructed sleeve 13*a* or 13*b* and the relative ring 21*a* or 21*b*, leaving the rod 11 free to reciprocate and continue governing the remaining elements 5. Clearly, each ring 21*a* and 21*b* will be positioned on the rod 11 at a distance from the contraposed end of the relative sleeve 13*a* and 13*b* which is at least equal to the rectilinear distance (measured parallel to the longitudinal axis X of the rod 11), covered by the pin 17 when rotating between its two limit positions.

Thus, in the event that metering is lost, say on one cylinder, remaining parts of the fuel injection system can continue to operate normally without any adverse effects on other mechanical components or on the air intake, given that the power loss will be relatively small; accordingly, the safety of the override device is amply demonstrated, especially in the case of propulsion units for light aircraft as used in tourism.

WHAT IS CLAIMED:

1. A malfunction override device applicable to the fuel injection system in a compression-ignition diesel engine, comprising:

a crankcase and block accommodating a plurality of pistons disposed parallel one with another and invested with reciprocating motion;

a cylinder head fitted over and combining with the block to create a plurality of combustion chambers, and supporting a corresponding plurality of fuel injectors mounted each with one end penetrating the relative combustion chamber and connected by the remaining end to one corresponding element of a fuel injection pump;

drive means, synchronized with the movement of the pistons, by which the elements of the injection pump are engaged and operated;

rotatable means associated with each element of the injection pump and serving to meter the volume of fuel supplied to the relative injector;

a control rod disposed parallel to the drive means and adjacent to the injection pump, by which the metering means of the various pumping elements are interconnected, exhibiting a plurality of rigidly associated shoulders located one alongside each element, and linked at one end to control means capable of inducing rectilinear movement of the rod such as will ensure uniform operation of all the metering means in concert;

a plurality of sliders associated with the control rod in contraposed pairs, each pair positively separated by a respective shoulder, capable singly of movement in relation to the rod and affording peripherally embodied linkage and transmission means that project transversely in the direction of an adjacent pump element in such a way as to engage and maneuver the relative metering means between two limit positions corresponding respectively to the maximum and minimum delivery settings of the injection pump;

tension means associated with each slider, located between the control rod on the one hand and the relative slider on the other, of which the elastic force is calibrated with respect to the rectilinear reaction force of the rotatable metering means in a way such as enables continued rectilinear movement of the rod even in the event that regular movement of at least one of the metering means between its two limit positions should become inhibited.

2. A device as in claim 1, wherein linkage and transmission means are embodied as a pair of mutually parallel tongues each rigidly associated with the contraposed end of a relative slider, designed to embrace and perpendicularly engage a pin forming part of metering means that consist in a bushing, rotatably and coaxially accommodated by the pumping element, to which a strap is attached that projects from the element in the direction of the control rod and carries the pin at its unattached end.

3. A device as in claim 1, wherein tension means are embodied as springs coaxially ensheathing the control rod and registering at either end with the relative slider, on the one hand, and on the other, with a relative seating ring coaxially encircling and secured rigidly to the rod in a position such that the distance separating each ring from the contraposed end of the corresponding slider is not less than the rectilinear distance, measured at least parallel to the longitudinal axis of the control rod, covered by rotation of the metering means between the two limit positions.

4. A device as in claim 1, wherein each shoulder is embodied as a distance collar coaxially encircling and secured to the control rod and separating the contraposed ends of a relative pair of sliders.

5. A device as in claim 1, wherein the sliders take the form of sleeves coaxially ensheathing the control rod.

* * * * *